US008616270B2

(12) United States Patent
Granchelli, Jr.

(10) Patent No.: US 8,616,270 B2
(45) Date of Patent: Dec. 31, 2013

(54) TENNIS BALL CONDITIONER

(76) Inventor: Ralph Samuel Granchelli, Jr., Sedona, AZ (US)

( * ) Notice: Subject to any disclaimer, the term of this patent is extended or adjusted under 35 U.S.C. 154(b) by 0 days.

(21) Appl. No.: 13/411,533

(22) Filed: Mar. 3, 2012

(65) Prior Publication Data

US 2013/0228305 A1 Sep. 5, 2013

(51) Int. Cl.
*F25B 29/00* (2006.01)

(52) U.S. Cl.
USPC ..... 165/201; 206/315.9; 273/317; 473/569

(58) Field of Classification Search
USPC ..... 165/201, 48.1, 58, 59, 61, 64; 206/315.9; 273/317; 473/569
See application file for complete search history.

(56) References Cited

U.S. PATENT DOCUMENTS

| | | | | | |
|---|---|---|---|---|---|
| 2,721,600 | A * | 10/1955 | Perryman | 156/273.7 |
| 3,710,519 | A * | 1/1973 | Jones | 52/2.17 |
| 3,853,316 | A * | 12/1974 | Smith | 473/496 |
| 4,019,629 | A * | 4/1977 | Dubner et al. | 206/315.9 |
| 4,020,948 | A * | 5/1977 | Won | 206/315.9 |
| 4,046,491 | A * | 9/1977 | Roeder | 417/44.2 |
| 4,073,120 | A * | 2/1978 | Berggren | 53/79 |
| 4,086,743 | A * | 5/1978 | Hoopes | 53/79 |
| 4,101,029 | A * | 7/1978 | Feinberg et al. | 206/315.9 |
| 4,124,117 | A * | 11/1978 | Rudy | 206/213.1 |
| 4,165,770 | A * | 8/1979 | Goldman et al. | 141/329 |
| 4,299,345 | A * | 11/1981 | Lanzl | 224/666 |
| 4,372,095 | A * | 2/1983 | De Satnick | 53/79 |
| 4,678,108 | A * | 7/1987 | Inman | 224/274 |
| 5,002,196 | A * | 3/1991 | Bassili | 220/240 |
| 5,044,495 | A * | 9/1991 | Wyslotsky | 206/315.9 |
| 5,083,415 | A * | 1/1992 | Schneider et al. | 53/432 |
| 5,397,018 | A * | 3/1995 | Mader | 221/102 |
| 5,593,157 | A * | 1/1997 | Koros et al. | 473/606 |
| 5,615,596 | A * | 4/1997 | Issa | 92/98 R |
| 5,695,055 | A * | 12/1997 | Kormanik, Jr. | 206/315.9 |
| 5,730,286 | A * | 3/1998 | Eska | 206/315.9 |
| 5,772,535 | A * | 6/1998 | Murphy | 473/415 |
| 6,357,282 | B1 * | 3/2002 | Benjamin | 73/81 |
| 6,508,732 | B1 * | 1/2003 | Romberger et al. | 473/606 |
| 6,640,993 | B2 * | 11/2003 | Nakamura et al. | 220/669 |
| 7,153,467 | B2 * | 12/2006 | Brum et al. | 264/553 |
| 7,226,961 | B2 * | 6/2007 | Park et al. | 523/205 |
| 7,658,211 | B1 * | 2/2010 | Dirst | 141/11 |
| 7,833,117 | B2 * | 11/2010 | Tiura | 473/550 |
| 7,935,288 | B2 * | 5/2011 | Brum et al. | 264/250 |
| 2001/0002653 | A1 * | 6/2001 | Ohno et al. | 206/459.5 |
| 2005/0014578 | A1 * | 1/2005 | Kennedy, III | 473/378 |

* cited by examiner

*Primary Examiner* — Ljiljana Ciric

(57) ABSTRACT

An apparatus for the conditioning, storage and transportation of tennis balls. The tennis ball conditioning, storage, and transportation apparatus is used to condition tennis balls, primarily by heating to a desired operating temperature. Conditioning modifies the internal pressure of the balls and warms the composition of the balls to the desired playing temperature. The tennis ball conditioning, storage, and transportation apparatus includes a housing which may have handles and which has an interior which contains heating and/or cooling elements and which functions as a conditioning and storage chamber. The chamber is divided by a screen upon which the balls rest. A thermostatically controlled heater, cooler and fan achieve the desired temperature then stabilizes the balls at the desired temperature.

20 Claims, 4 Drawing Sheets

TENNIS BALL CONDITIONER

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

BACKGROUND OF THE INVENTION

1. Field of the Invention

The present invention relates to of sporting goods.

More particularly, the present invention relates to of tennis. In particular the present invention relates to an apparatus to improve the bounce performance of cold tennis balls.

It is known that the bounce performance of a tennis ball varies approximately forty percent as the temperature of the ball drops from a temperature of seventy degrees Fahrenheit to a temperature of thirty degrees Fahrenheit. Therefore when a ball is cold, the bounce performance of the ball is significantly diminished making it difficult to play tennis. This is a universal problem experienced by all players of the sport.

2. Background Art

U.S. Pat. No. 4,372,095 (issued to De Satnick on Feb. 8, 1983) discloses a device using a needle to pierce a tennis ball and inject a gas into the ball to adjust the pressure within the ball.

In contrast, the tennis ball conditioner of the instant application utilizes heat to increase the internal pressure of the ball and to heat the entire composition of the ball to improve the bounce performance of the ball.

There is no invasive puncturing of the ball and no possibility of subsequent leaking due to the piercing of the ball membrane.

Thus, the inventive tennis ball conditioner of the instant application solves the cold tennis ball bounce performance problem by rapidly heating tennis balls to the desired operating temperature.

BRIEF SUMMARY OF THE INVENTION

The tennis ball conditioner apparatus comprises an insulated housing with internal thermostatically controlled heating, cooling and variable speed fan to quickly warm tennis balls to the operating temperature. The balls are then stabilized or maintained at the desired operating temperature. The apparatus conditions the balls for use primarily by heating and also stores a varying number of balls ready for transportation.

Playing tennis with cold tennis balls that will not bounce properly is a universal problem experienced by all players of the sport when the ambient temperature is too cold.

The bounce performance of a tennis ball decreases by approximately 40% as temperature decreases from 70 degrees F. to 30 degrees F.

The tennis ball conditioner solves this problem by rapidly heating tennis balls to the desired operating temperature then stabilizing said balls at the desired temperature.

DETAILED DESCRIPTION OF THE INVENTION

The preferred embodiment of the tennis ball conditioner of the present invention is disclosed hereby and in FIGS. 1 through 4 of the instant application. However, this invention may be embodied in many different forms and should not be construed as limited to the embodiments set forth herein.

Figure 1:
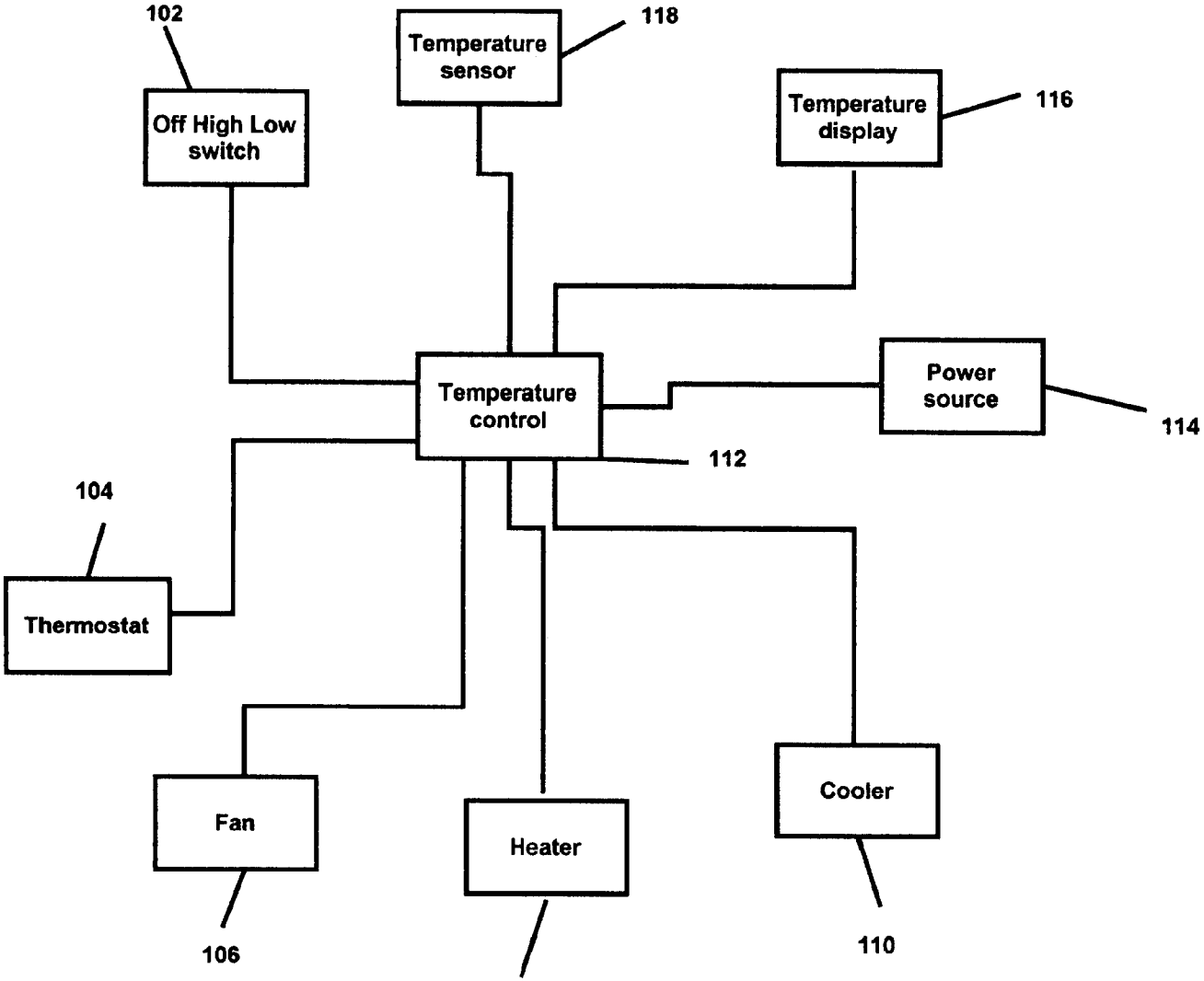
FIG. 1 shows a functional block diagram of the present invention.

FIG. 1 is a functional block diagram depicting one embodiment of the tennis ball conditioner. The tennis ball conditioner, according to the invention includes an Off/Hi/Lo switch 102 to energize the temperature control 112. Power source 114 may have a plurality of voltages. Off/Hi/Lo switch 102 selects the heat range and the blower speed. Off/Hi/Lo switch in either the Hi or Lo positions energizes the fan 106, the heater 108 and the cooler 110. Temperature sensor 118 senses the ball temperature. Thermostat 104 sets the desired ball temperature. The actual ball temperature is depicted on temperature display 116.

Figure 2:
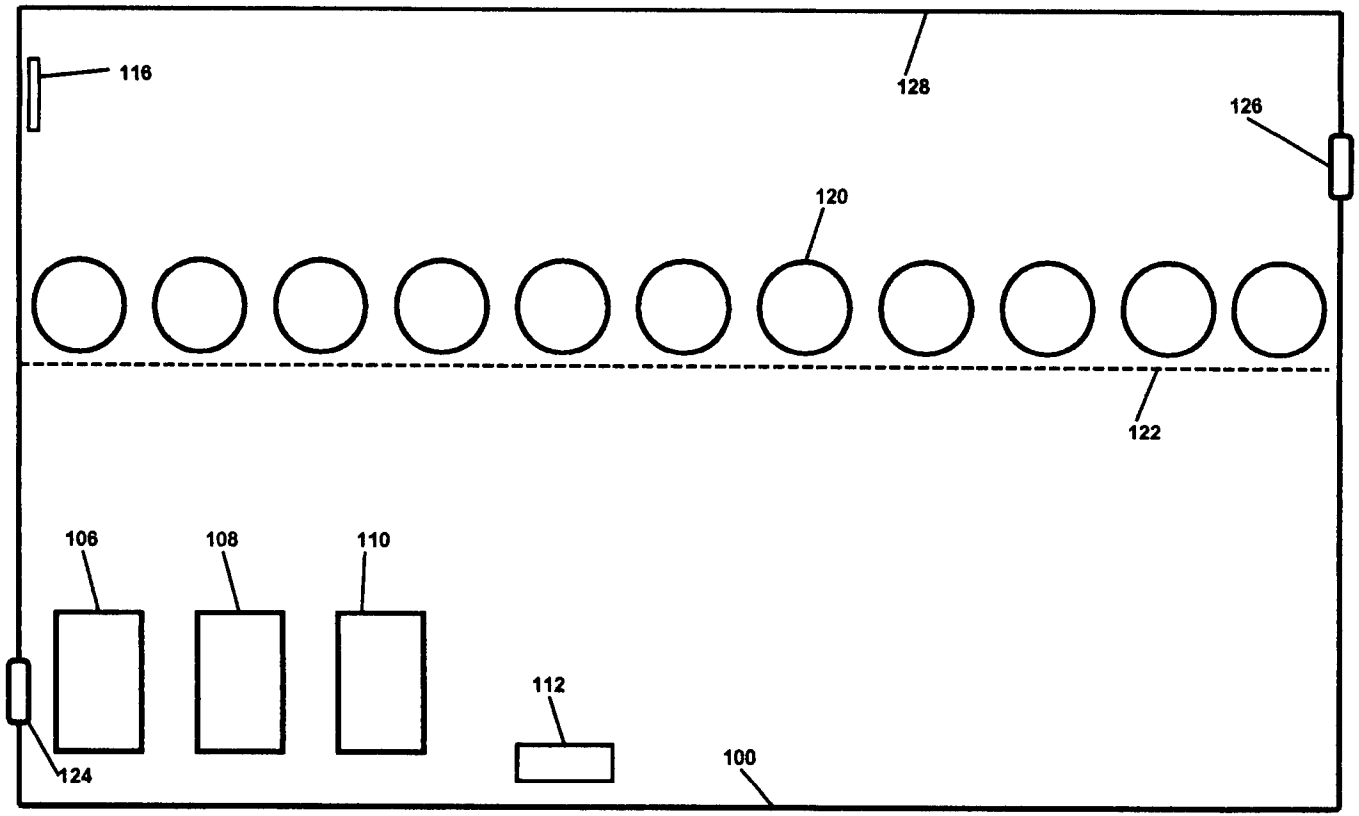
FIG. 2 shows a side view of the present invention.

FIG. 2 depicts a side view of the tennis ball conditioner in on embodiment of the tennis ball conditioner. The tennis ball conditioner according to the invention includes a housing 100 to contain the balls and all of the components of the tennis ball conditioner. Temperature sensor 116 detects the temperature of the balls. Screen 122 divides the upper and lower chambers of the housing. Screen 122 provides a surface for the balls 120 to rest upon. Air flow freely passes through the screen 122, permeating all area inside the housing. Inlet vent 124 provides air flow to the fan 106, which then is forced through the heater 108 and the cooler 110. Electrical circuitry is managed by the temperature control 112. Air is exhausted through exhaust vent 126. Handle 140 provides for ease of transportation.

Figure 3:
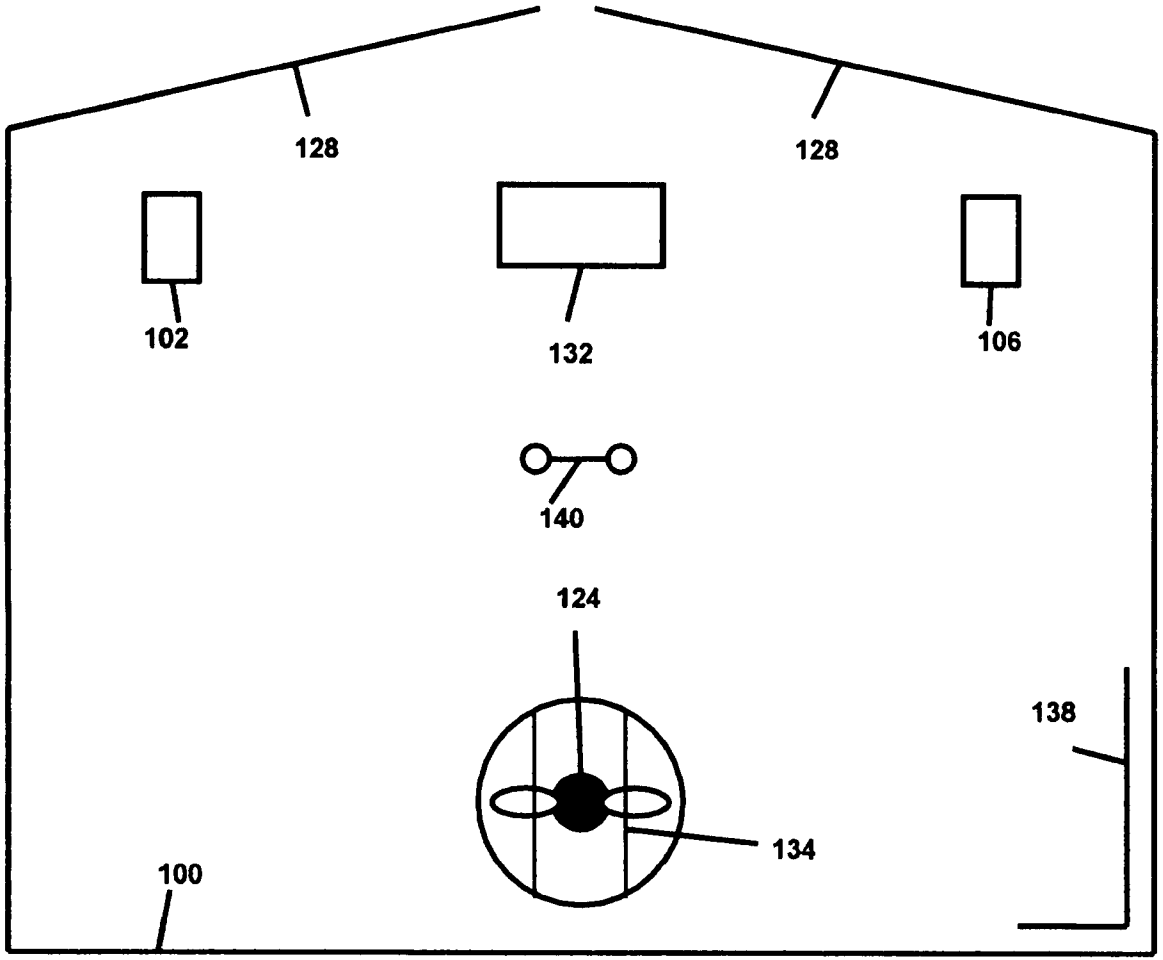
FIG. 3 shows a front view of the present invention.
Figure 4:
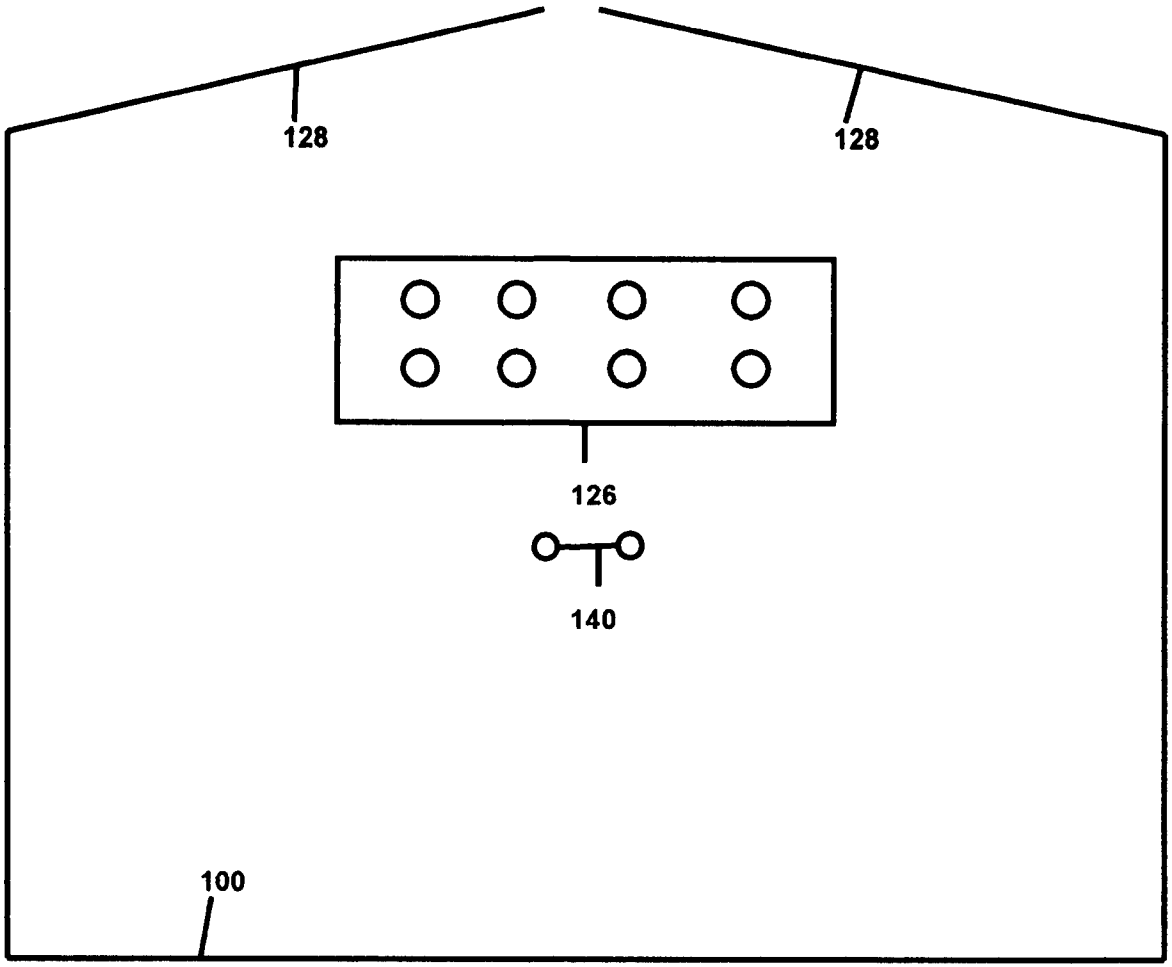
FIG. 4 shows a rear view of the present invention.

The tennis ball conditioner shown in FIGS. 2, 3, and 4 of the drawings has a housing 100 which includes a cover 128.

FIG. 3 is a front view of the tennis ball conditioner in one embodiment of the tennis ball conditioner. Cover 128 provides interior access to the storage and conditioning chamber within the housing. Off/Hi/Lo switch 102 energizes the circuitry of the tennis ball conditioner. Thermostat 106 provides the control to set the desired temperature within the housing and therefore the temperature of the ball's. Air intake 124 provides air flow into the heater and cooler. Air intake cover 134 provides protection from the fan blades. Insulation 138 lines the interior of the housing. Handle 140 provides for ease of transportation.

FIG. 4 is a rear view of one embodiment of the tennis ball conditioner. Exhaust vent 126 provides for controlled air circulation.

For clarity, within this document all reference to the top and bottom of the tennis ball conditioner will correspond to the tennis ball conditioner of the FIG. 2 when oriented such that the text is upright corresponding to top of the tennis ball conditioner, and the bottom of the figure when oriented such that the text is upright corresponding to the bottom of the tennis ball conditioner. Likewise, all reference to the front of the tennis ball conditioner will correspond to the leftmost part of the tennis ball conditioner as viewed in FIG. 2 when oriented with the text upright, and all reference to the rear of the tennis ball conditioner will correspond to the rightmost part of the tennis ball conditioner as viewed in FIG. 2 when oriented with the text upright.

CLOSING STATEMENT

Having thus described in detail a preferred embodiment of the present invention, the tennis ball conditioner, it is to be appreciated and will be apparent to those skilled in the art that many changes not exemplified in the detailed description of the invention could be made without altering the inventive concepts and principles embodied therein. It is also to be appreciated that numerous embodiments incorporating only part of the preferred embodiment are possible which do not alter, with respect to those parts, the inventive concepts and principles embodied therein. The presented embodiments are therefore to be considered in all respects as exemplary and not as restrictive, the scope of the invention being indicated by the appended claims, and all alternate embodiments and changes to the embodiments shown herein which come within the meaning and range of equivalency of the appended claims are therefore to be embraced therein.

What I claim as my invention is:

1. A tennis ball conditioner for conditioning tennis balls, said tennis ball conditioner comprising:

a thermally controllable housing for thermal conditioning, storage, and transportation of tennis balls, the housing including an associated access cover for providing access to the interior of the housing;

an air permeable screen disposed within the housing for providing a surface upon which tennis balls can rest during thermal conditioning, storage, and transportation thereof;

a thermostatically controllable heater and cooler along with a fan operable at a plurality of voltages to thermally condition any tennis balls located within the housing by modifying the temperature of the tennis balls to achieve a desired ball temperature and pressure, and to thereby improve the performance of the ball;

an insulating layer lining at least a portion of the interior of the housing for reflecting heat; and, inlet and exhaust ports for controlled airflow into and out of the housing.

2. The tennis ball conditioner according to claim 1 which further comprises handles attached to the housing to facilitate transporting the housing.

3. The tennis ball conditioner according to claim 1 which comprises a thermostat for setting the desired temperature of any tennis ball located within the housing.

4. The tennis ball conditioner according to claim 3 which comprises a temperature sensor for detecting the actual temperature of any tennis ball located within the housing.

5. The tennis ball conditioner according to claim 4 which comprises a temperature display for depicting said actual temperature.

6. The tennis ball conditioner according to claim 3 which comprises a temperature control operably connected to each of the thermostat, the heater, the cooler, and the fan.

7. The tennis ball conditioner according to claim 1 wherein the screen divides the housing into two chambers include an upper chamber and a lower chamber.

8. The tennis ball conditioner according to claim 1 which comprises a switch for energizing the fan, heater, and cooler and for selecting at least the speed of the fan.

9. The tennis ball conditioner according to claim 8 wherein the switch is an OFF/Hi/Lo switch.

10. The tennis ball conditioner according to claim 8 which comprises a temperature control operably connected to the each of the thermostat, the heater, the cooler, the fan, and the switch.

11. The tennis ball conditioner according to claim 10 which comprises a power source.

12. The tennis ball conditioner according to claim 1 which comprises a power source.

13. The tennis ball conditioner according to claim 3 which comprises: a temperature sensor for detecting the actual temperature of any tennis ball located within the housing.

14. The tennis ball conditioner according to claim 13 which comprises a temperature display for depicting said actual temperature.

15. A tennis ball conditioner for conditioning tennis balls, said tennis ball conditioner comprising:

a thermally controllable housing for thermal conditioning, storage, and transportation of tennis balls, the housing including an associated access cover for providing access to the interior of the housing;

an air permeable screen disposed within the housing for providing a surface upon which tennis balls can rest during thermal conditioning, storage, and transportation thereof;

a means for thermally conditioning any tennis balls within the housing to improve the bounce and performance of the balls; and, inlet and exhaust ports for controlled airflow into and out of the housing, wherein the housing is insulated.

16. The tennis ball conditioner according to claim 15, wherein the means for thermally conditioning any tennis balls within the housing includes a thermostatically controllable heater with a fan operable at a plurality of voltages by modifying the temperature of the tennis balls to achieve a desired ball temperature and pressure.

17. The tennis ball conditioner according to claim 16 which further includes a cooler to stabilize or maintain any tennis balls within the housing at the desired ball temperature and pressure.

18. The tennis ball conditioner according to claim 17 which comprises handles attached to the housing to facilitate transporting the housing.

19. The tennis ball conditioner according to claim 17 which comprises a thermostat for setting the desired temperature of any tennis ball located within the housing; a temperature sensor for detecting the actual temperature of any tennis balls located within the housing; a temperature display for depicting said actual temperature; a temperature control operably connected to the means for thermally conditioning tennis balls as well as to the thermostat and to the temperatures sensor; and, a switch for energizing the means for thermally conditioning tennis balls.

20. The tennis ball conditioner according to claim 15 which comprises a thermostat for setting the desired temperature of any tennis ball located within the housing; a temperature sensor for detecting the actual temperature of any tennis balls located within the housing; a temperature display for depicting said actual temperature; a temperature control operably connected to the means for thermally conditioning tennis balls as well as to the thermostat and to the temperatures sensor; and, a switch for energizing the means for thermally conditioning tennis balls.

* * * * *